US007926203B2

(12) United States Patent
Wilkenfeld

(10) Patent No.: US 7,926,203 B2
(45) Date of Patent: Apr. 19, 2011

(54) DANCE FOOTWEAR

(75) Inventor: David Wilkenfeld, Sydney (AU)

(73) Assignee: Pointe Noir Pty Ltd. (AU)

( * ) Notice: Subject to any disclaimer, the term of this patent is extended or adjusted under 35 U.S.C. 154(b) by 800 days.

(21) Appl. No.: 11/873,211

(22) Filed: Oct. 16, 2007

(65) Prior Publication Data

US 2008/0086912 A1 Apr. 17, 2008

Related U.S. Application Data

(60) Provisional application No. 60/829,843, filed on Oct. 17, 2006.

(51) Int. Cl.
*A43B 5/12* (2006.01)

(52) U.S. Cl. ..... 36/8.3

(58) Field of Classification Search ..... 36/8.3, 36/102, 113, 25 R, 31
See application file for complete search history.

(56) References Cited

U.S. PATENT DOCUMENTS

| | | | |
|---|---|---|---|
| 1,872,641 | A | 8/1932 | Capezio |
| 1,930,188 | A | 10/1933 | Arthur |
| 1,953,659 | A | 4/1934 | Savino |
| 2,237,652 | A | 4/1941 | Capezio |
| 2,252,315 | A | 8/1941 | Doree |
| 2,596,038 | A | 5/1952 | Mayer |
| 2,683,316 | A | 7/1954 | Reker et al. |
| 2,701,925 | A | 2/1955 | Luhr |
| 2,740,207 | A | 4/1956 | Starensier |
| 2,780,013 | A | 2/1957 | Voss |
| 4,277,897 | A | 7/1981 | O'Connell |
| 4,495,715 | A | 1/1985 | Fredrickson et al. |
| 4,583,304 | A | 4/1986 | Spalding |
| 4,944,099 | A | 7/1990 | Davis |
| 5,035,069 | A | 7/1991 | Minden |
| 5,129,165 | A | 7/1992 | Woodle |
| 5,191,726 | A | 3/1993 | Vallee |
| 5,220,735 | A | 6/1993 | Raoul-Duval |
| D339,669 | S | 9/1993 | Miller |
| 5,257,969 | A | 11/1993 | Mance |
| 5,384,973 | A | 1/1995 | Lyden |

(Continued)

FOREIGN PATENT DOCUMENTS

| | | |
|---|---|---|
| CA | 1077711 | 5/1980 |

(Continued)

OTHER PUBLICATIONS

Capezio Dance Product Data Sheet, Footundeez, Jun. 27, 2005, pp. 1.

(Continued)

*Primary Examiner* — Ted Kavanaugh
(74) *Attorney, Agent, or Firm* — Ganz Law, PC

(57) ABSTRACT

A foot covering, including a thin, flexible compartment for receiving a foot, the compartment having a forefoot section, a mid-section, and a heel section. The compartment has a top surface for securing the foot and a ground-facing surface having at least a forefoot outsole portion in the forefoot section. The forefoot outsole portion is disposed mainly in the forefoot section, and has a shape that is wider than it is long; corresponding approximately to the width of a foot and covering approximately the first to the fifth metatarsal heads. The mid-section of the compartment is mainly free of outsole material. The inventive subject matter is further directed towards a method for manufacturing such a foot covering.

16 Claims, 8 Drawing Sheets

U.S. PATENT DOCUMENTS

| | | | | |
|---|---|---|---|---|
| 5,513,449 | A | 5/1996 | Gramola | |
| 5,623,734 | A | 4/1997 | Pugliatti | |
| 5,682,685 | A | 11/1997 | Terlizzi | |
| 5,806,209 | A | 9/1998 | Crowley et al. | |
| 5,865,779 | A | 2/1999 | Gleason | |
| 5,867,838 | A | 2/1999 | Corry | |
| 5,956,868 | A | 9/1999 | Stevens et al. | |
| 5,996,251 | A | 12/1999 | LaDuca | |
| 6,018,888 | A | 2/2000 | Wilkenfeld et al. | |
| 6,076,284 | A | 6/2000 | Terlizzi | |
| D437,105 | S | 2/2001 | Mahjied | |
| 6,418,641 | B1 * | 7/2002 | Schenkel | 36/28 |
| 6,588,124 | B2 | 7/2003 | Morrone | |
| 6,634,121 | B2 | 10/2003 | Sordi | |
| 6,800,063 | B2 | 10/2004 | Iwata | |
| D499,807 | S | 12/2004 | Stauffer | |
| 6,857,203 | B2 * | 2/2005 | Minden | 36/8.3 |
| 6,895,693 | B2 | 5/2005 | Baruck | |
| 6,895,694 | B2 | 5/2005 | Nye | |
| 6,915,596 | B2 * | 7/2005 | Grove et al. | 36/100 |
| D517,784 | S | 3/2006 | Wilkenfeld et al. | |
| 7,051,457 | B1 | 5/2006 | Huggins et al. | |
| D522,722 | S | 6/2006 | Wilkenfeld et al. | |
| D530,888 | S | 10/2006 | Kim | |
| D535,461 | S | 1/2007 | Wilkenfeld et al. | |
| D538,515 | S | 3/2007 | Wilkenfeld et al. | |
| D551,430 | S | 9/2007 | Wilkenfeld et al. | |
| D556,436 | S | 12/2007 | Wilkenfeld et al. | |
| D558,957 | S | 1/2008 | Wilkenfeld et al. | |
| D559,504 | S | 1/2008 | Wilkenfeld et al. | |
| 2001/0005947 | A1 | 7/2001 | Sordi | |
| 2002/0078591 | A1 | 6/2002 | Morrone | |
| 2002/0166257 | A1 | 11/2002 | Wilkinson | |
| 2003/0029055 | A1 | 2/2003 | Morrone | |
| 2003/0033729 | A1 | 2/2003 | Farrior | |
| 2003/0070319 | A1 | 4/2003 | Minden | |
| 2003/0121176 | A1 | 7/2003 | Baruck | |
| 2006/0196078 | A1 | 9/2006 | Terlizzi et al. | |
| 2006/0288609 | A1 | 12/2006 | Wilkenfeld et al. | |
| 2007/0006486 | A1 | 1/2007 | Wilkenfeld et al. | |
| 2008/0034613 | A1 | 2/2008 | Wilkenfeld et al. | |
| 2008/0086906 | A1 | 4/2008 | Wilkenfeld | |

FOREIGN PATENT DOCUMENTS

| | | | |
|---|---|---|---|
| CH | 168702 | | 4/1933 |
| EP | 0562697 | | 9/1993 |
| EP | 0672362 | A1 | 9/1995 |
| WO | WO9938404 | A1 | 8/1999 |
| WO | 99/51117 | | 10/1999 |
| WO | WO02051274 | A1 | 7/2002 |
| WO | 2006/037154 | | 4/2006 |

OTHER PUBLICATIONS

Dance Paws Product Data Sheet, Dance Paws, Feb. 24, 2006, pp. 1-3.

Examination report dated Sep. 12, 2008 for corresponding Australian patent application No. AU2005291828, filed Sep. 29, 2005; 3 pages.

Examination report dated Apr. 3, 2008 for related Australian patent application No. AU2007202498, filed May 31, 2007; 2 pages.

PCT International Search Report and Written Opinion dated Nov. 7, 2005 prepared by ISA/AU for PCT Appl. No. PCT/AU2005/001504; filed Sep. 29, 2005; 11 pages.

Office Action dated Nov. 12, 2010 for related U.S. Appl. No. 11/576,879, filed Oct. 19, 2007. (18 pages).

* cited by examiner

DANCE FOOTWEAR

CROSS REFERENCE TO RELATED APPLICATIONS

This application claims priority to and the benefit of U.S. provisional patent application No. 60/829,843, filed Oct. 17, 2006 by David Wilkenfeld, entitled "DANCE FOOTWEAR," which is hereby incorporated by reference as if included herein in its entirety for all purposes.

BACKGROUND

The inventive subject matter disclosed herein relates to light weight, flexible foot coverings in general, and more particularly to dance shoes, such as ballet shoes, of a new and improved construction that permits better foot protection and greater flexibility.

Ballet and modem dance can include periods of running, jumping, spinning, leaping, and physical interactions among several individuals. The driving desire to achieve extremes in movement in ballet has spawned the development of footwear meant to facilitate graceful and inspiring movements, such as rotating on the tips of the toes or walking and landing on the toes, even if these movements are not natural movements for the average person. Dance shoes enable these dance steps and can help protect the dancer's feet by distributing forces and pressures resulting from dance steps over a wide area of the outside surface of the foot and by addressing foot-to-surface or shoe-to-surface frictional requirements.

However, traditional dance shoes or ballet slippers may not feel comfortable or provide sufficient protection, especially when pivoting and the dancer balances on the metatarsal head area of the foot. The outsoles usually have an oval or tear-drop shape and are traditionally longer than wider. This may create a feeling of discomfort, particularly after prolonged wear because the dancer can feel the outsole border (e.g., because of a seam line) when weight-bearing on the metatarsal heads. Moreover, these slippers do not allow enough protection and support at the ball of the foot. FIG. 5A shows a typical outsole configuration of a traditional ballet slipper. As can be seen, the first and fifth metatarsal heads, as well as the first and fifth proximal phalanges, are not uncovered or just partially covered. The pressure on at least these metatarsal heads against hard surfaces may cause deep contusions called "stone bruises". In general, the materials used for outsoles are usually bulky and hard, thereby impeding movement of the foot at the midfoot. The tear drop shape of the heel section contributes to a feeling of discomfort in the midfoot because of the presence of outsole material extending into the midfoot. Accordingly there is a need for light-weight, flexible footwear for dancers that provides the feet better protection and flexibility.

SUMMARY

The inventive subject matter offers a solution for these problems by providing a foot covering with the following qualities, alone or in combination.

In one possible embodiment, the inventive subject matter is directed to a foot covering, including a thin, flexible compartment for receiving a foot, the compartment having a forefoot section, a mid-section, and a heel section. The compartment has a top surface for securing the foot and a ground-facing surface having at least a forefoot outsole portion formed of a thin and flexible material. The forefoot outsole portion is disposed mainly in the forefoot section and has a shape that is wider than it is long; corresponding approximately to the width of a foot and covering approximately the first to fifth metatarsal heads and wherein the mid-section is mainly free of outsole material.

In the foregoing embodiment, the ground-facing surface is mainly free of stiffening material at the mid-section of the compartment.

In the foregoing embodiment, the forefoot outsole portion may have a proximal edge extending to just proximal at least four of the five metatarsal heads, at least one metatarsal head being the first metatarsal, and has a distal edge that extends to about the metatarsal-phalangal joints.

The foot covering may also include a heel outsole portion positioned at the heel of the ground-facing surface of the compartment and separated from the forefoot outsole portion by a mid-section free of outsole. In the foregoing embodiment, the forefoot outsole portion has a substantially kidney-like shape.

In the foregoing embodiment, the compartment may be formed of at least two different materials. In the foregoing embodiment, a ground-facing surface may be provided with flat pleats. In the foregoing embodiment, the compartment may be configured with the following additional configuration elements: formed of a substantially single ply material; formed with a forefoot outsole portion adapted to reduce bunching of the compartment material; provided with a binding to hold the compartment on a foot.

In another possible embodiment, a foot covering may have a forefoot outsole portion which is positioned asymmetrically relative to the longitudinal line of the foot and the forefoot outsole portion is shifted towards the medial side of the foot. In the foregoing embodiment, the forefoot outsole portion may have a substantially kidney-like shape, which is asymmetrical with less material of the forefoot outsole portion covering the lateral side of the foot. In the foregoing embodiment, the forefoot outsole portion may be positioned asymmetrically relative to the longitudinal line of the foot and the forefoot outsole portion is shifted towards the medial side of the foot.

In another possible embodiment, a foot covering may include a compartment for receiving a foot and the compartment may be formed of a thin and flexible material, the compartment has a forefoot section, a mid-section, and a heel section. The compartment further has a top surface for securing the foot, and a ground-facing surface having a forefoot outsole portion disposed mainly in the heel section, and a mid-section mainly free of outsole material. The forefoot outsole portion has a shape that is wider than it is long and corresponding approximately to the width of a foot and covering approximately the first to the fifth metatarsal heads, and the heel outsole portion underlying approximately the talus of the foot.

In the foregoing embodiments, the foot covering may have a compartment that is formed on a last having a base surface with a length to width ratio of about 3/1.

The inventive subject matter further contemplates a method for manufacturing a foot covering, including using a last to form a thin, flexible compartment for receiving a foot, the compartment has a forefoot section, a mid-section, and a heel section. The compartment further has a top surface for securing the foot and a ground-facing surface which has at least a forefoot outsole portion disposed mainly in the forefoot section, and the compartment being mainly free of outsole material in the mid-section. The forefoot outsole portion may have a shape that is wider than it is long and corresponding approximately to the width of a foot and covering approximately the first to the fifth metatarsal heads. In the foregoing method, the last may have a base surface with a length to width ratio of about 3/1.

In any of the foregoing embodiments of the foot covering and the method of manufacturing the foot covering, the covering may be constructed as a ballet slipper with the light-weight and flexible materials.

These and other embodiments are described in more detail in the following detailed descriptions and the figures. The embodiments disclosed herein provide a foot covering that is simple, feels comfortable from the first wear, and protects and cushions the foot. The foot covering does not restrict or constrain the foot as the foot moves through various positions, especially when pivoting. This embodiment enables the ball of the foot to stretch and expand as necessary, as well as provide more traction in certain areas and less traction in other areas.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The following figures show various embodiments of inventive subject matter (except where prior art is noted).

DETAILED DESCRIPTION

Figure 1:
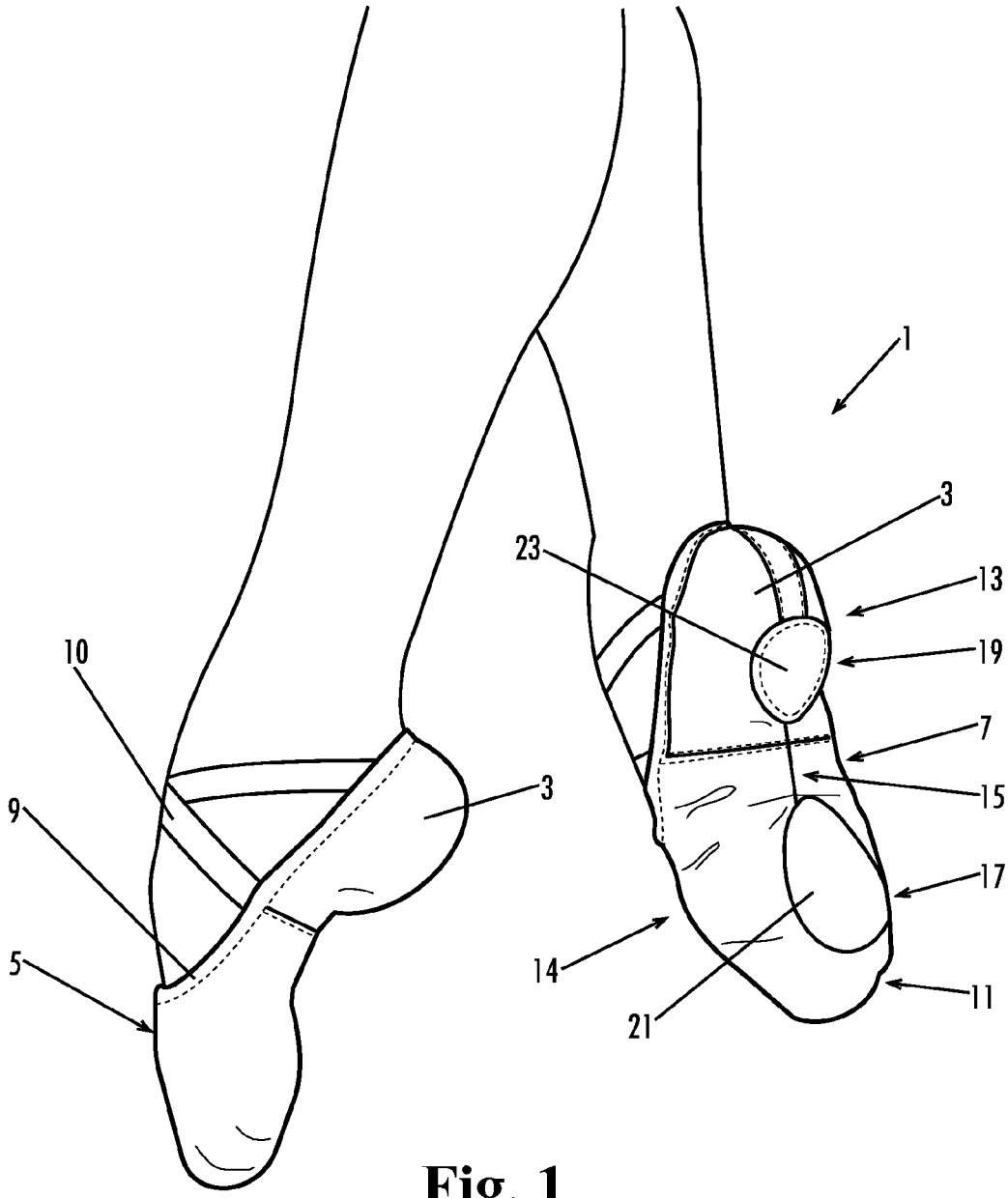
Fig. 1 Prior Art
FIG. 1 shows a perspective view of left and right foot coverings according to the prior art.

Representative embodiments of the inventive subject matter are shown in FIGS. 3, 4, 5B 6B, 7A and 7B, wherein the same or similar features share common reference numerals.

An overview of foot anatomy will help illustrate the invention, and facilitate a better understanding of it. The forefoot is composed of five toes and their connecting long bones, the metatarsals. Each toe, or phalanx, is made up of small bones, the phalanges. The big toe, or hallux has two phalanges, two joints, the interphalangeal joints; and two tiny, round sesamoid bones that enable it to move up and down. The other four toes each have three bones and two joints. The second row of phalanges is connected to the metatarsal heads by five metatarsal phalangeal joints at the ball of the foot, i.e., where the foot is normally at its widest.

The midfoot has five irregularly shaped tarsal bones, which form the foot's arch. The rearfoot is composed of three joints and links the midfoot to the ankle (talus). The top of the talus is connected to the two long bones of the lower leg (tibia and fibula), forming a hinge that allows the foot to move up and down. The heel bone (calcaneus) is the largest bone in the foot. It joins the talus to form the subtalar joint, which enables the foot to rotate at the ankle.

Figure 2:
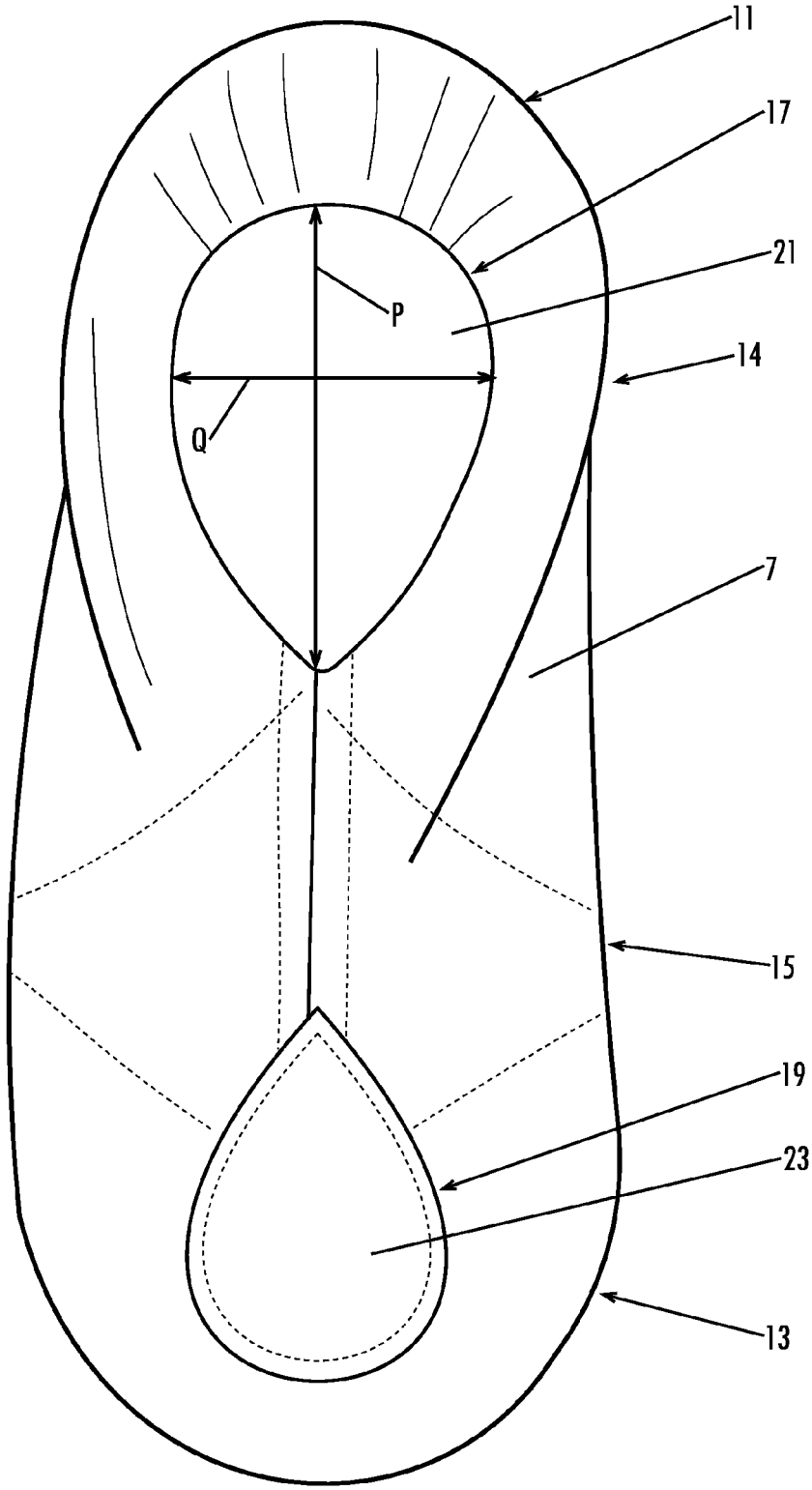
Fig. 2 Prior Art
FIG. 2 shows a bottom view of a foot covering according to the prior art.
Figure 3:
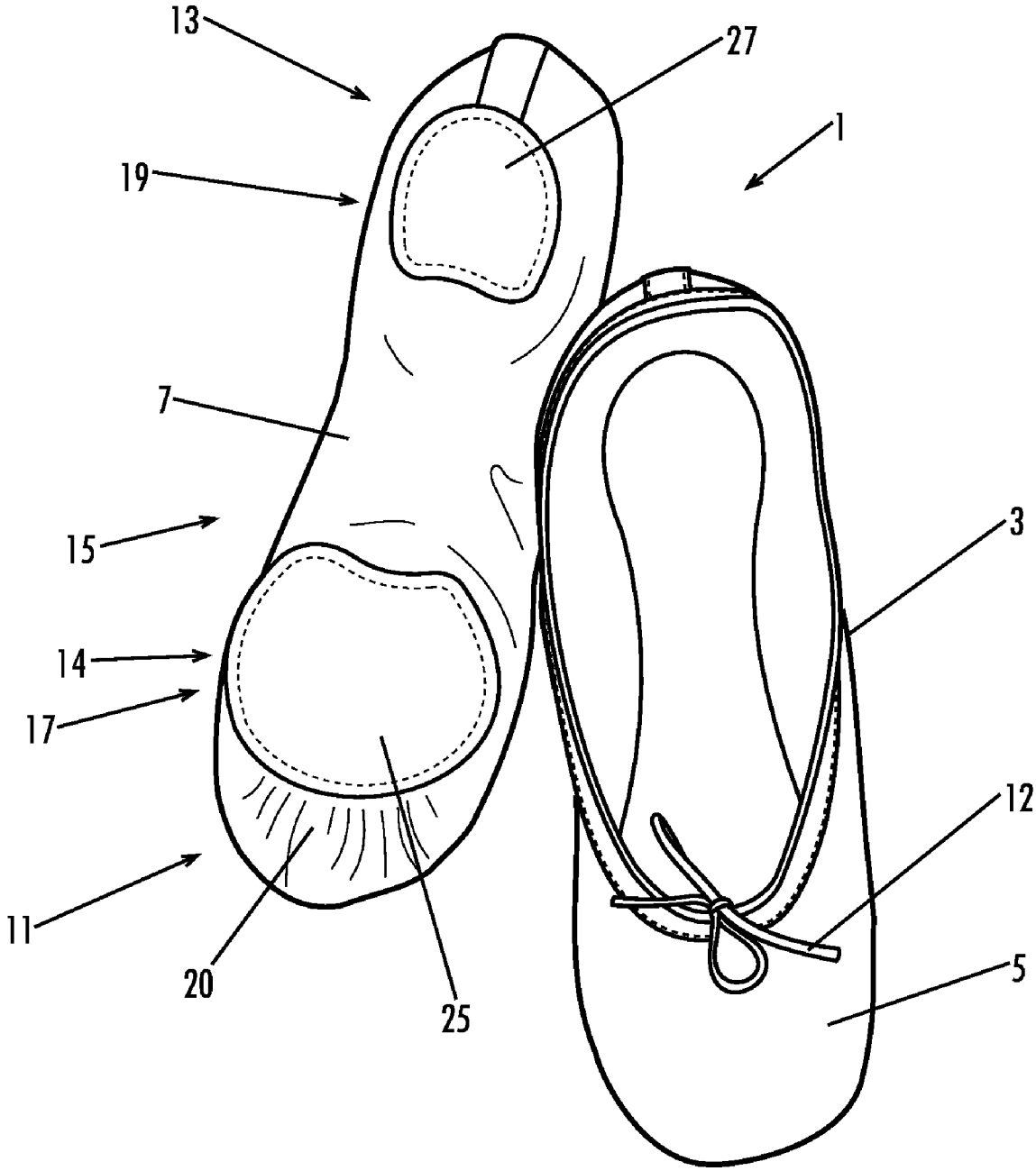
FIG. 3 shows a perspective view of left and right foot coverings.
Figure 4:
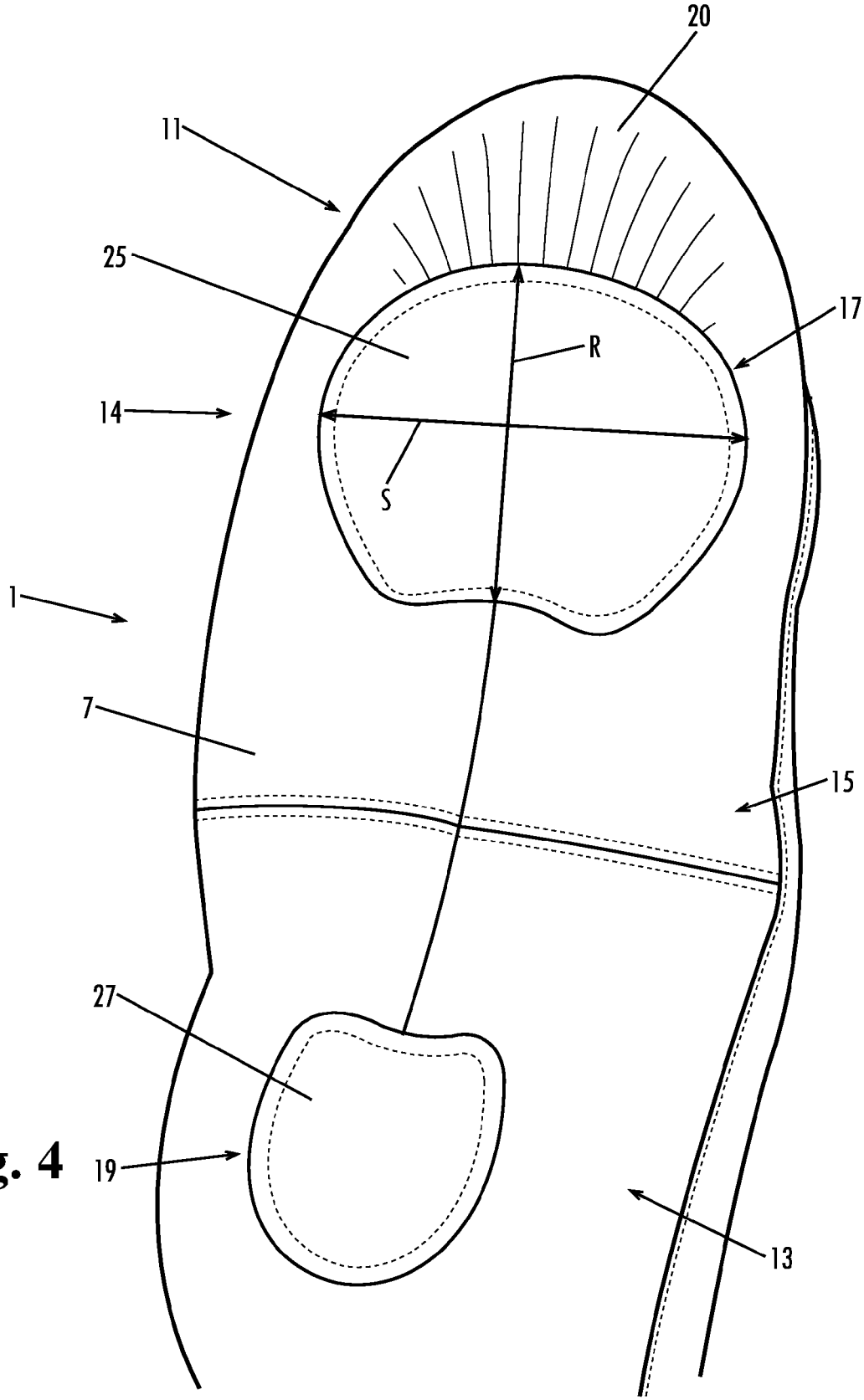
FIG. 4 shows a bottom view of a foot covering.

FIGS. 1 and 2 illustrate a dance shoe as known in the prior art, while FIGS. 3-4 illustrate an example embodiment of the inventive subject matter. In general, a foot covering or dance shoe includes a compartment for receiving a foot. Hereinafter, the terms "dance shoe" and "foot covering" are used interchangeably. Here, a dance shoe 1 is shown with a compartment 3 having a top surface 5, for securing the foot, and a ground-facing surface 7. The compartment 3 is usually formed of a thin and flexible material, such as a fabric that is adapted to cover a foot. For example, the compartment may be formed of a light-weight, stretchable mesh material, such as cotton, canvas, leather, or synthetics. The top surface may also be in the form of straps or bands of material.

Figure 5A:
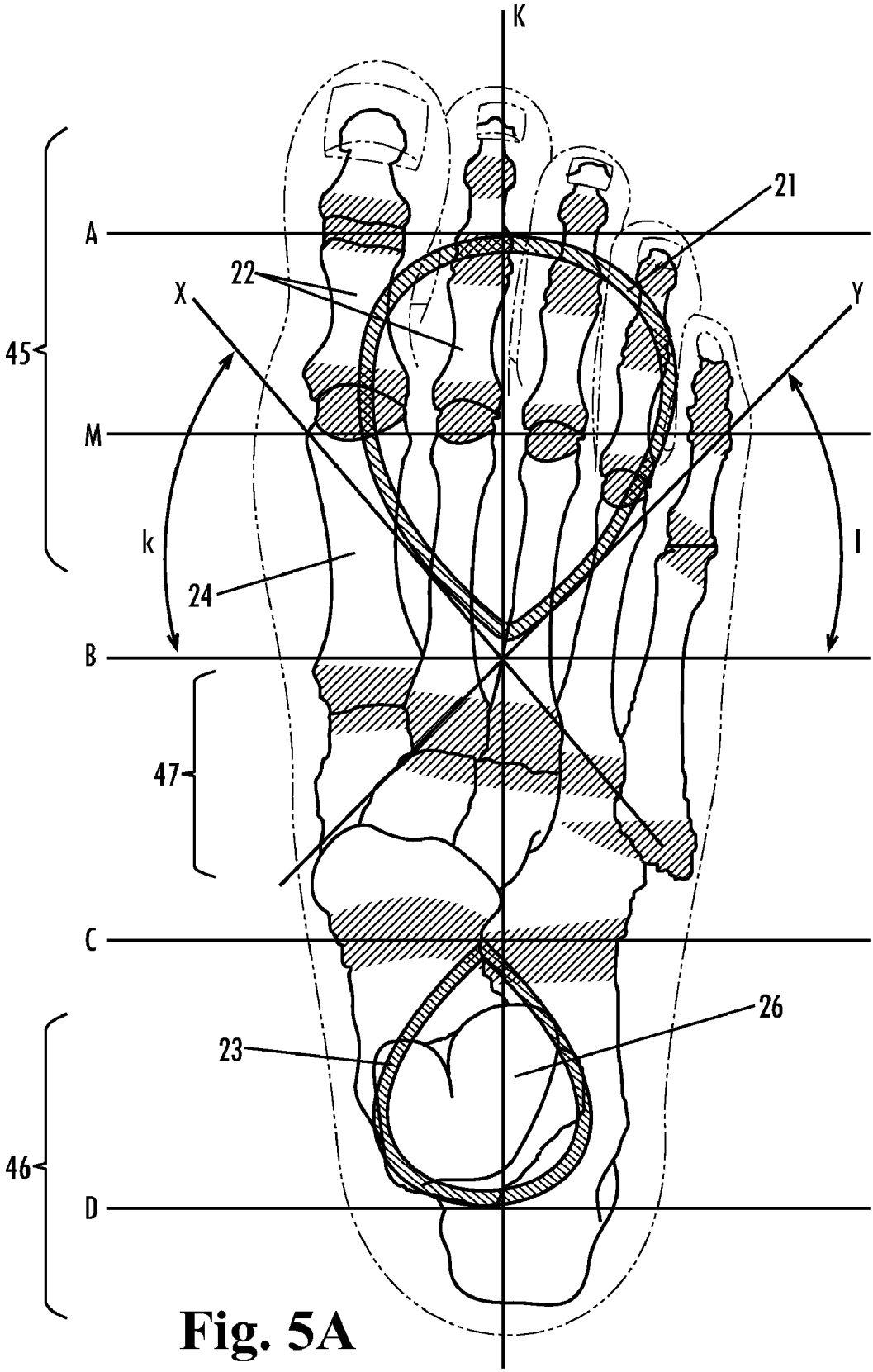
Fig. 5A Prior Art
FIG. 5A shows a bottom view of the skeletal structure of a foot with a graphic representation of the location of the outsole portions according to the prior art.

Compartment 3 includes a toe section 11, a heel section 13, and a mid-section 15. The ground-facing surface 7 of compartment 3 includes a first sole region 17 and a second sole region 19. The ground-facing surface 7 of the dance shoe 1 usually has one or more protective pads or outsole portions designed to better protect the foot. These protective outsole portions are incorporated into the sole of the dance shoe as a split sole structure, namely the forefoot portion is separated from the heel portion. Such a separation allows the midfoot area of the shoe to be unconstrained by the less-forgiving nature of the materials used to form the outsole portions. FIGS. 1 and 5A illustrate a prior art dance shoe 1, with a first forefoot outsole portion 21 that underlies the forefoot section 45 of the foot, corresponding to the toe section 11 and ball section 14 of the dance shoe; and a second heel outsole portion 23, spaced from the forefoot outsole portion, that underlies the rearfoot 46 of the foot, corresponding to the heel section 13 of the dance shoe 1. The outsole portions 21 and 23 are located at the ground-facing surface 7 of the dance shoe 1 along a longitudinal line K of the foot. This longitudinal line K runs from the toes to the heel, at the middle of the foot.

The mid-section 15 of the foot is not protected by either the forefoot or heel outsole portion, but is part of the flexible material of the compartment 3 that extends between the forefoot and heel outsole portions. As illustrated in FIGS. 1 and 5A, the heel outsole portion 23 usually underlies the talus 26 of the foot at the heel section 13.

FIG. 5A illustrates the skeletal structure of a right foot and the perimeter of outsole portions 21 and 23 according to the typical prior art. Traditionally the outsole portions are always longer than wider. The two substantially oval shaped outsole portions 21 and 23, have a rounded side and a pointed side. The pointed sides of the outsoles are facing each other and are directed towards the mid-section of the ground surface. Outsole portions 21 and 23 are located along a longitudinal line K running along the length of the foot, as mentioned above. Forefoot outsole portion 21 also runs along a metatarsal line M running from one side of the foot to the other side, perpendicular to the longitudinal line K, at the widest point of the foot where the metatarsal joints are located.

In particular, forefoot outsole portion 21 is situated in the area of the metatarsal-phalangal joints, along a metatarsal line M and between two parallel lines A and B, also running perpendicular to the longitudinal line K. Line A is located at the distal end of the foot at the end of the phalanges 22, while line B is located towards the proximal end of the foot at the metatarsals 24. The shape of forefoot outsole portion 21 is substantially tear-drop or oval-like, with a rounded side towards the proximal end of the foot, the top of which touches line A. The pointed side of forefoot outsole portion 21 approximately touches line B. The sides are determined by tangent lines X and Y intersecting at the tip of the pointed outsole portion 21 and line B, determining angles k and l.

Similarly, the location of the heel outsole portion 23 at the heel section is determined by lines C and D, running perpendicular to the longitudinal line K of the foot, as shown in FIG. 5A. Line C is located at the heel section towards the distal end of the foot, while line D is located at the heel section towards the proximal end of the foot. The rounded side of outsole portion 23 touches line D and the tip of the pointed side of the outsole portion is situated at the intersection of line C and the longitudinal line K.

FIG. 2 illustrates the dimension of protective outsoles according to a prior art dance shoe size 4C. The dimensions Q/P of forefoot outsole portion 21 are about 47 mm width (Q)×67 mm length (P). The length of the outsole is measured along a longitudinal line P of the outsole, while the width of the outsole is measured along a metatarsal line Q of the outsole.

FIGS. 3 and 4 illustrate a dance shoe according to an example embodiment wherein the pattern of the outsoles is modified. In this embodiment, a split sole ballet slipper is shown where the forefoot outsole portion is shorter and wider than the outsole portion of the prior art, thus creating a flatter and broader platform on which to pivot. The shorter and wider profile also provides better protection over the areas where protection is most needed. The forefoot outsole portion 25 is disposed mainly in the forefoot section 45 of the foot. The shape of the forefoot outsole portion 25, covers approximately the width of a foot from about at least the first four metatarsal heads to about the rears of those metatarsals and has a substantially kidney-like shape. The forefoot outsole portion 25 underlies approximately the forefoot section 45 of the foot, corresponding to the toe section 11 and the ball section 14 of the dance shoe, however, the kidney-like shaped outsole portion covers less of the metatarsals towards the mid-section 15 of the dance shoe, compared with the outsoles of the prior art dance shoe discussed above. The forefoot outsole portion 25 may leave as much as possible of the midfoot uncovered with outsole material, while still covering at least four metatarsal heads when the person wearing the foot covering is in demi-position and provide traction when the person wearing the foot covering stands on a flat surface. The length of the forefoot outsole portion extends from just proximal (at about line F, FIG. 5B) the metatarsal heads to about the second proximal row of phalanges (at about line E, FIG. 5B). The forefoot outsole 25 is positioned relative to the foot so that the outsole protects the widest part of the foot, which is associated with the metatarsal heads on which may weight-bearing dance moves and other moves occur.

Optionally, the dance shoe may also have a second or heel outsole portion 27, which is positioned at the heel section 13 of the ground-facing surface 7 of the compartment 3. The forefoot and heel outsole portions are spaced from one another to accommodate changes to the foot as the foot moves through various positions. The exact distances between the protective outsoles of the forefoot and heel may vary depending upon the size and shape of the foot. Additionally, the exact geometric shape of the protective outsoles may also vary in response to several factors such as the size of the foot, but will be in keeping with the principle that the forefoot outsole portion will be wider than it is long and will be disposed so as to have a proximal edge extending to about line F in FIG. 5B and distal edge extending to about line E in FIG. 5B, and so as to cover at least four of the five metatarsal heads.

As can be seen, the forefoot outsole portion 25 is disposed mainly in the forefoot section 11, although there is a small portion extending proximally into the mid-section 15. Accordingly, the mid-section 15 of the dance shoe may be said to be mainly free of outsole material. Additionally, the mid-section of the ground-facing surface 7 of the dance shoe may lack stiffening material. Stiffening material may be desirable in single piece outsole shoes, like for example certain types of dance shoes, dress shoes, or athletic shoes. In general, a high degree of flexibility is desirable at the midfoot on the ground-facing surface of ballet slippers. Where needed, some degree of stiffness may be provided by insoles placed in the compartment of the foot covering.

In general, outsole portions 25 and 27 may be constructed by eliminating excess material of the prior art outsoles 21 and 23, for example by eliminating material from the length at the pointed tips, leaving a rounded curve, and adding to the sides of the outsole, extending the forefoot outsole along the width of at least the first four metatarsals to provide a broader amount of metatarsal coverage. The resulting outsole has about the same surface area as the prior art outsole; however, it provides a more functional shape where it is needed most. This foot covering may be implemented to achieve one or more of various purposes, including, as examples, to protect a dancer's foot, to create a flatter platform to pivot on, to increase flexibility, to provide an improved amount of metatarsal protection.

Figure 5B:
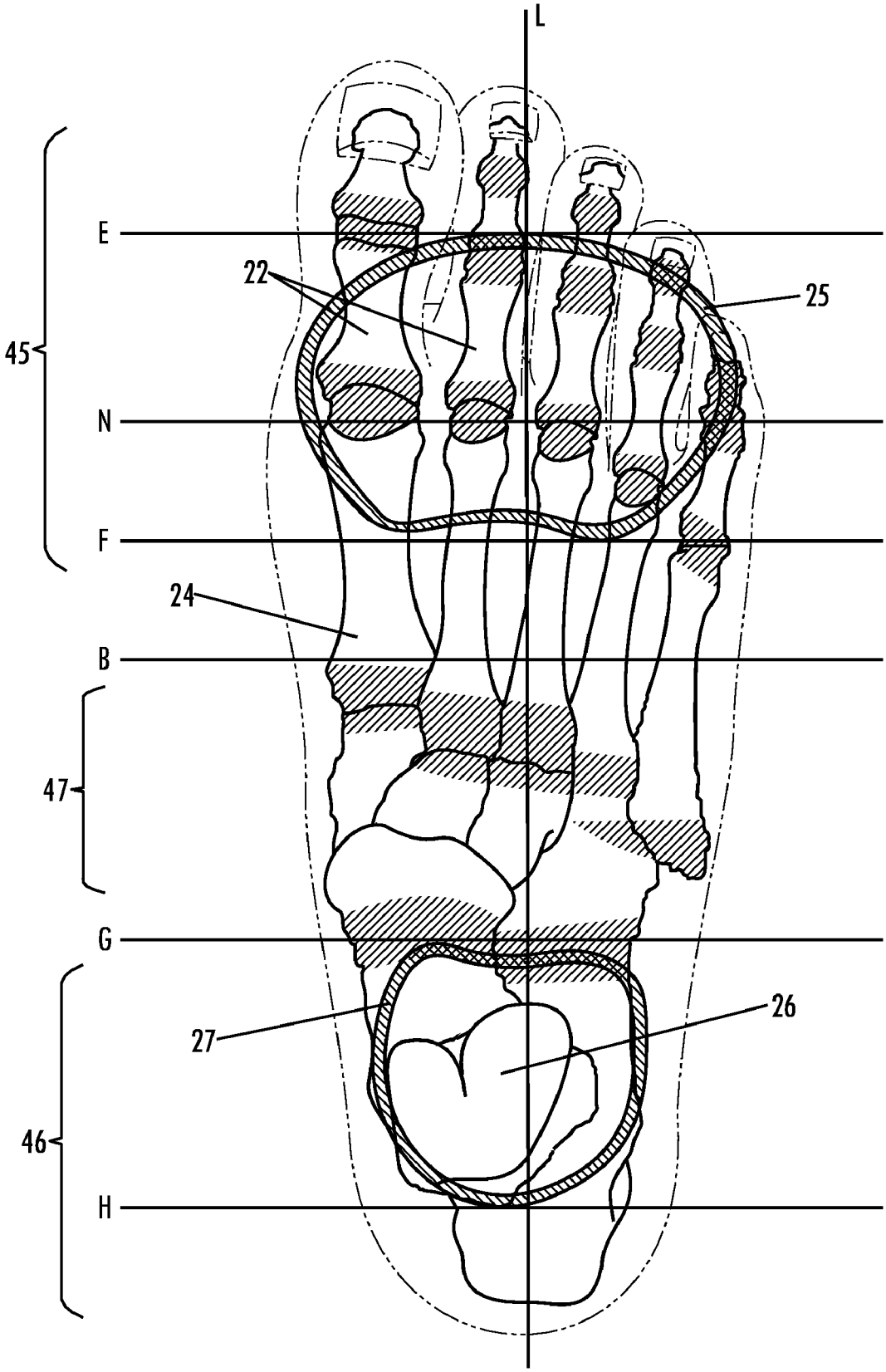
FIG. 5B shows a bottom view of the skeletal structure of a foot with a graphic representation of the location of the outsole portions according to an embodiment of the inventive subject matter.

FIG. 5B illustrates the skeletal structure of a typical right foot and the perimeter profile of outsole portions 25 and 27, according to an example embodiment of the inventive subject matter. The length of forefoot outsole portion 25 runs along a longitudinal line L of the foot. In particular, the length of outsole 25 is substantially situated in the area of the metatarsal-phalangal joints, along a metatarsal line N and between two parallel lines E and F, which run perpendicular to the longitudinal line L. Line E is located at the distal end of the foot, approximately at the joining of the first and second rows of the phalanges 22; while line F is located towards the proximal end of the foot. The distal end of outsole portion 25 touches line E, approximately at the intersection of line E and longitudinal line L. The proximal side of outsole portion 25 touches line F. Thus, the forefoot outsole portion 25 covers almost all of the metatarsal heads and the second proximal row of phalanges 22. In contrast to the prior art outsoles described in FIG. 5A, the particular shape of the embodiment shown in 5B has tangential lines at very small angles or no angles relative to angles k and l. Additionally, the distance between lines E-F is smaller than the distance between lines A-B. As illustrated in FIG. 5B, this results in an outsole 25, which is wider than prior art outsole, and the width of the forefoot outsole portion 25 covers at least four of the five metatarsal bones 24. Outsole 25, in this embodiment, has a shape similar to a kidney or a bean. The kidney-like shape of the forefoot outsole portion 25 shown in FIGS. 3, 4, and 5B is symmetrical. This means that when the outsole portion is folded along a longitudinal line, the left and right portions of the outsole are identical.

Similarly, the location of the heel outsole portion 27 at the heel section 13 is determined by lines G and H, running perpendicular to the longitudinal line L of the foot. As shown on FIG. 5B, line G is located at the heel section towards the distal end of the foot, while line H is located at the heel section towards the proximal end of the foot. The distal tip of heel outsole portion 27 touches line G. The proximal end of the outsole portion 27 touches line H. Overall, the heel outsole portion in this embodiment has a substantially kidney-like shaped area that underlies the talus 26 of the foot.

The dimensions (S/R) of the forefoot outsole portion 25, as shown in the foot covering of FIG. 4, are about 73 mm width (S)×58 mm length (R) for a size 4C dance shoe, measured along a metatarsal line S and a longitudinal line R, respectively. This results in a wider and more rounded outsole compared to the prior art protective outsole.

Also shown in FIGS. 3 and 4, is a ground-facing surface provided with flat pleats 20 in the toe section 11 of the compartment 3. These flat pleats 20 help ensure that there are no lumps under the foot.

The dance shoe 1 may be held on a foot by a binding 9, as shown in FIG. 1. The binding may be elastic or non-elastic. The binding 9 defines a foot opening in the compartment 3. When placing the foot into dance shoe 1, the binding 9 may be slightly stretched to enlarge the size of the foot opening. Sometimes elastic straps 10 are incorporated with the binding 9 to secure the dance shoe. As shown in FIG. 3, a drawstring 12, attached to an edge of the fabric, may also be used to adjust the size of the foot opening. The drawstring may be any material, such as an elastic or non-elastic cord.

The inventive subject matter also contemplates a method for manufacturing of footwear in accordance with the disclosure, including assembling parts in order to achieve the articles disclosed. A method of manufacturing such a foot covering may include a step of forming a compartment for receiving a foot by using a last, having dimensions as described below, for example. The compartment is formed on the last by providing a top surface for securing the foot, and a ground-facing surface. According to one embodiment of the inventive subject matter, the foot coverings are symmetrical and interchangeable for use on left or right foot. The ground-facing surface is provided with a forefoot outsole portion that may have a shape corresponding approximately to the width of a foot covering at least four of the five metatarsals and a length covering approximately the metatarsal heads and the second proximal row of phalanges.

The foot compartment is typically made using one or more plies of a light weight fabric, and is free of boards or other stiffening materials, such as foam midsoles or shanks. The protective outsole portions may be made of a thin, flexible material that is more rugged than the fabric for the foot compartment and would typically be formed of a durable material for ground contact, such as natural or synthetic leather, and such materials may include patterns, finishes or textures such as suede. For certain styles of dance a thin flexible outsole is desired, which may be provided by a single ply of such materials. In general, the protective outsoles are spaced from one another so that the material between the outsoles can flex and stretch to accommodate changes to the foot as the foot moves through various positions.

Figure 6B:
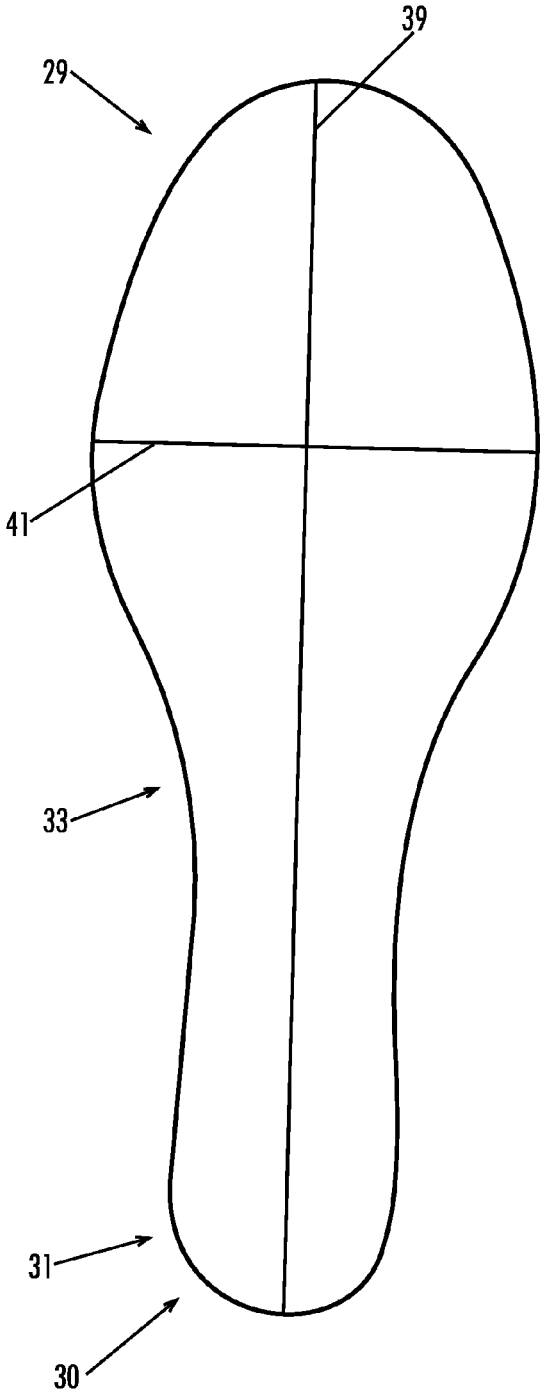
FIG. 6B shows a last as used for constructing a foot covering.
Figure 6A:
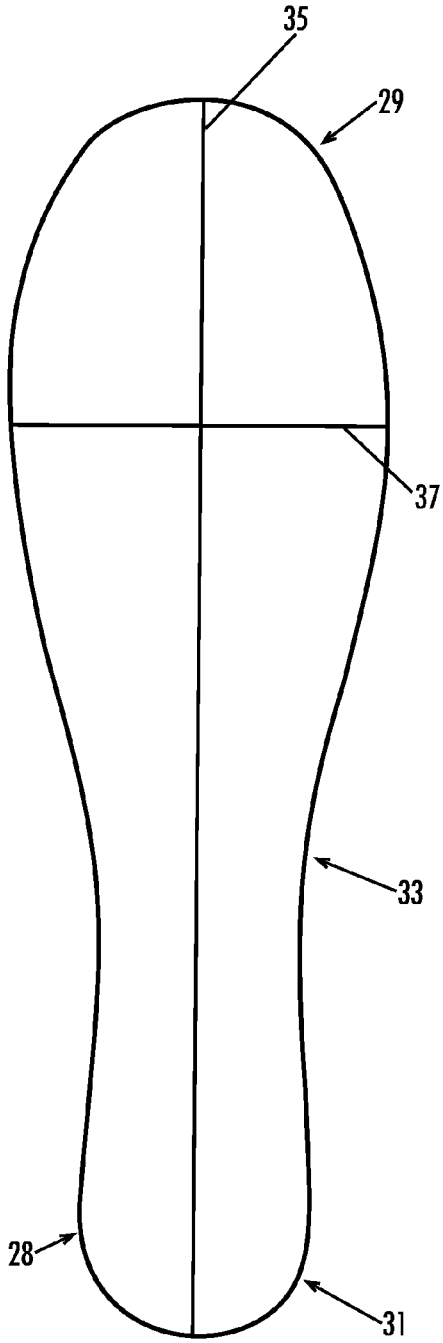
Fig. 6A Prior Art
FIG. 6A shows a last as used for constructing a foot covering according to the prior art.

Traditional dance shoes are formed on a last having a particular length and width which depends on the shoe size, for example ladies sizes 2 to 8.5, and widths, for example B, C or D. The base or plantar surface of a last 28, having dimensions of a women's US shoe size 4C, for example, as used in the prior art, is shown in FIG. 6A. The last 28 has a toe section 29, a heel section 31, and a mid section 33. The length of this particular last is about 215 mm along the longitudinal line 35 of the last 28, while the width is about 65 mm along the metatarsal line 37, thus giving a length to width ratio of 215/65 or approximately 3.3/1. By comparison, a last 30 according to the inventive subject matter shows about the same length but is much wider, i.e., the area of the metatarsal heads. FIG. 6B illustrates an example of such a last for a shoe size 4C. This last 30 also has a toe section 29, a heel section 31, and a mid-section 30. The last 30 is modified in such a way that it provides for a wider base of the dance shoe. Although the length along the longitudinal line 39 is substantially the same as the last of the prior art, the width along the metatarsal line 41 is wider than the width of the prior art last. This particular last 30 has a length of about 215 mm and a width of about 77 mm, measured along the longitudinal line 39 and metatarsal line 41 respectively, and thus giving a length to width ratio of 215/77 or approximately 3/1. The wider area on the last 30 allows for easy attachment of the outsole portion to the compartment. The measurement for the instep circumference, which is the widest point on the forefoot of the last, is about 21 cm on both lasts.

Figure 7A:
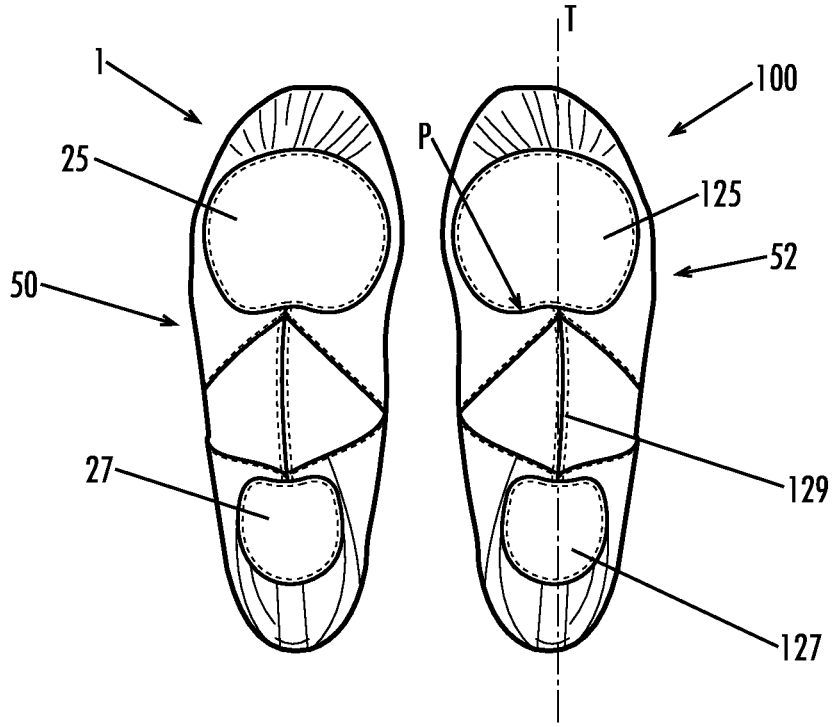
FIG. 7A shows a bottom view of left and right foot coverings.
Figure 7B:
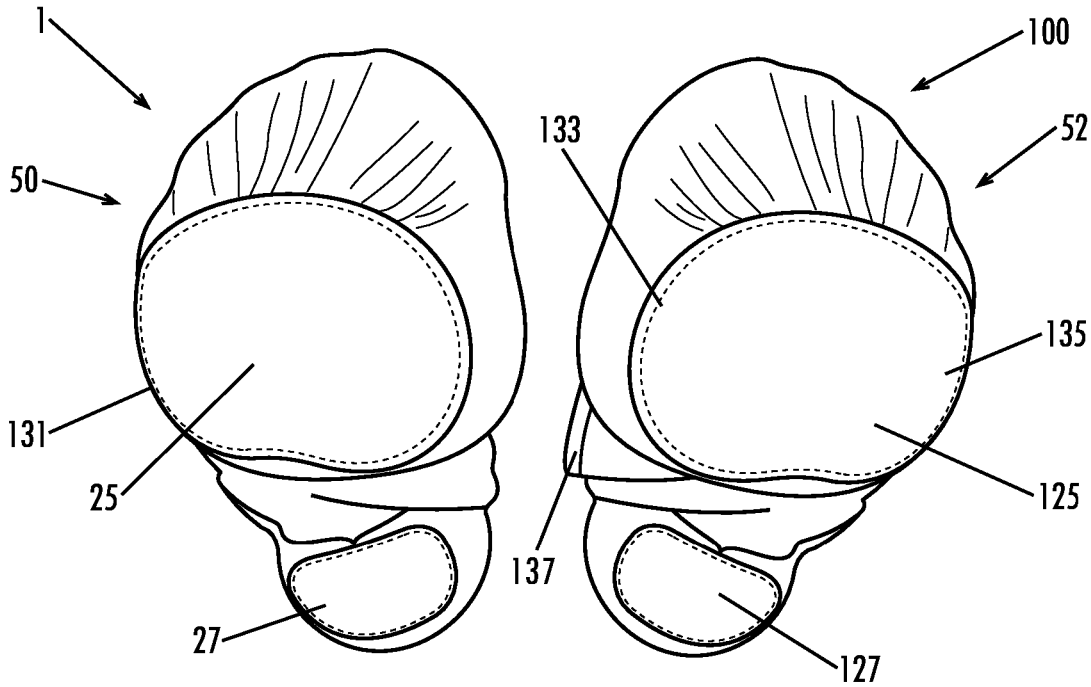
FIG. 7B shows another bottom view of left and right foot coverings according to the embodiment shown in FIG. 7A, while the person wearing the foot covering is standing in a demi position.

Another embodiment of the inventive subject matter is illustrated in FIGS. 7A-B, illustrating a right foot 50 with a foot covering 1 as described above and a left foot 52 wearing a foot covering 100 according to another embodiment of the inventive subject matter having an asymmetrical outsole portion 125.

FIG. 7A shows a bottom view of feet wearing foot coverings 1 and 100, whereby the feet are positioned flat on a surface. The arrow P in FIG. 7A illustrates how a substantially kidney-shaped outsole portion 125 is positioned asymmetrically relative to a longitudinal line T of the foot covering 100. The longitudinal line T of the foot covering 100 runs approximately at the position of longitudinal seams 129 along the ground-facing surface of the foot covering 100. The forefoot outsole portion 125 is positioned asymmetrically relative to the longitudinal line T of the foot towards the medial side of the foot.

FIG. 7B illustrates the foot coverings 1 and 100 when the person wearing the foot coverings stands in a demi-pointe position, i.e. standing on the balls of the feet with the bottom of the toes in contact with the floor and the heels off the ground. In this position, more pressure is put on the medial side of the foot and more weight is supported by the big toe. Therefore, more support and traction are desirable on the medial side of the foot versus the lateral side of the foot.

As can be seen in FIG. 7B, when the right foot 50 is in a demi position, the foot covering 1 has excess material 131 at the forefoot outsole portion 25 on the lateral side of the foot. The foot covering 1 does not completely enclose the foot at the lateral side of the foot. Thus, the forefoot outsole portion 25 sticks out beyond the foot. The excess material 131 from the forefoot outsole portion 25 is removed on the asymmetrical outsole portion 125. Although outsole material is removed, the forefoot outsole portion 125 still covers at least four of the five metatarsal bones. The foot covering 100 on the left foot 52 shows a gap 137 because the foot covering 100 is worn without elastic instep straps.

The forefoot outsole portion 25 is symmetrical when folded along a longitudinal line of the outsole, while the forefoot outsole portion 125 is asymmetrical when folded along a longitudinal line of the outsole portion. The shape of the asymmetrical outsole portion 125 is approximately the same as forefoot outsole portion 25 on the medial side 133 of the foot, that is the side where the big toe is. However, the asymmetrical outsole portion 125 has about 2.5 mm less material along the metatarsal line on the lateral side 135 of the outsole portion 125, for example, in the case of a shoe size 3.5-4.

The substantially kidney-like shape of the outsole portion 125 provides an additional advantage because it reduces material bunching in the arch when pointing, while the tear drop shape of the prior art increases bunching.

A heel outsole portion 127 may be positioned at the heel section of the dance shoe, having a similar shape and position to heel outsole portion 27 of the previous embodiment. However, the heel outsole portion 127 may have any alternative shape or position that may be advantageous to facilitate movement of the foot in the mid-section of the foot covering.

A foot covering 100 having a forefoot outsole portion 125 may be formed on a last similar to the last described above and shown in FIG. 6B. However, the asymmetry of the outsole and positioning of the outsole on the compartment with a bias to the medial side, results in different foot coverings for left and right feet. These foot coverings are formed on lasts adapted for forming left or right foot coverings. The length of the last is similar to the length of the last described above with reference to FIG. 6B, i.e., about 215 mm along a longitudinal line 39 for the example shown. However, the compartment provided with an asymmetrical forefoot outsole portion, may be formed on a last having a slightly narrower dimension along the metatarsal line 41. For example, for a shoe size 3.5 B the dimension along the metatarsal line 41 is about 2.5 mm less on the lateral side of the foot. The width of the last along the metatarsal line 41 is about 74.5 mm. This results in a length to width ratio of 215/74.5 or approximately 3/1.

The dimensions and ratios given herein are representative. A person skilled in the art will be able to ascertain variances without undue effort that achieves the advantages disclosed herein. From the foregoing embodiments it should be appreciated that a dance shoe compartment can be constructed by stitching materials and elements together to result in flat and generally straight or regular lines that enhance fit and comfort. While the inventive subject matter disclosed herein is directed to a foot covering of substantially single ply material, other materials or plies may be added or otherwise used, e.g. to impart desired properties.

The outsoles may be attached to the compartment in a number of different ways as is known in the art, including adhesion and stitching.

In addition to the features discussed above, other embodiments may have split or partial uppers with, for example, elastic straps attached at the back of the dance shoe, allowing the dancer to adjust the position of the shoe.

It is understood that other embodiments may be provided, such as for example, varying one or more of the features set out in the example embodiments. To illustrate, such variations may be directed to one or more dimensions and/or positions of the soles or other body contours, shapes and dimensions.

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

All patent and non-patent literature cited herein, if any, is hereby incorporated by references in its entirety for all purposes.

The invention claimed is:

1. A foot covering, comprising:

a thin, flexible compartment for receiving a foot, the compartment having a forefoot section, a mid-section, and a heel section;

the compartment having a top surface for securing the foot and a ground-facing surface having at least a forefoot outsole portion in the forefoot section;

the forefoot outsole portion made of a thin, flexible material disposed mainly in the forefoot section, and having a shape that is wider than it is long; corresponding approximately to the width of a foot and covering approximately the first to the fifth metatarsal heads; and wherein the mid-section of the compartment is mainly free of outsole material.

2. The foot covering of claim 1, wherein the ground-facing surface is mainly free of stiffening material at the mid-section of the compartment.

3. The foot covering of claim 1, wherein the forefoot outsole portion has a proximal edge extending to just proximal at least four of the five metatarsal heads, at least one metatarsal head being the first metatarsal, and has a distal edge that extends approximately to the second proximal row of phalanges of a typical wearer's foot.

4. The foot covering of claim 1, further comprising a heel outsole portion that is positioned at the heel section of the ground-facing surface of the compartment and separated from the forefoot outsole portion by a mid-section mainly free of outsole material.

5. The foot covering of claim 4, wherein the heel outsole portion has a substantially kidney-like shape.

6. The foot covering of claim 1, wherein the forefoot outsole portion has a substantially kidney-like shape.

7. The foot covering of claim 1, wherein the compartment is formed of at least two different materials.

8. The foot covering of claim 1, wherein the compartment comprises a ground-facing surface provided with flat pleats.

9. The foot covering of claim 1, wherein the outsole portion is formed of a substantially single ply material.

10. The foot covering of claim 1, wherein the compartment is formed with a forefoot outsole portion adapted to reduce bunching of the compartment material.

11. The foot covering of claim 1, wherein the compartment further comprises a binding to hold the compartment on a foot.

12. The foot covering of claim 1, wherein the forefoot outsole portion is positioned asymmetrically relative to the longitudinal line of the foot and the forefoot outsole portion is shifted towards the medial side of the foot.

13. The foot covering of claim 1, wherein the forefoot outsole portion has a substantially kidney-like shape, which is asymmetrical with less material of the forefoot outsole portion covering the lateral side of the foot.

14. The foot covering of claim 13, wherein the forefoot outsole portion is positioned asymmetrically relative to the longitudinal line of the foot and the forefoot outsole portion is shifted towards the medial side of the foot.

15. A foot covering, comprising:

a compartment for receiving a foot and the compartment being formed of a thin and flexible material, the compartment having a forefoot section, a mid-section, and a heel section;

the compartment having a top surface for securing the foot, and a ground-facing surface having a forefoot outsole portion disposed mainly in the forefoot section, and a heel outsole portion disposed mainly in the heel section, and a mid-section mainly free of outsole material;

the forefoot outsole portion made of a thin, flexible material and having a shape that is wider than it is long and corresponding approximately to the width of a foot and covering approximately the first to the fifth metatarsal heads; and the heel outsole portion underlying approximately the talus of the foot.

16. The foot covering of claim 1, wherein the compartment is formed on a last having a base surface with a length to width ratio of about 3/1.

* * * * *